US009378611B2

(12) United States Patent
Powell

(10) Patent No.: US 9,378,611 B2
(45) Date of Patent: Jun. 28, 2016

(54) AUTOMATED ADJUSTMENT OF AUDIO EFFECTS IN ELECTRONIC GAME

(71) Applicant: Incredible Technologies, Inc., Vernon Hills, IL (US)

(72) Inventor: Jeffrey Rogers Powell, Sugar Grove, IL (US)

(73) Assignee: INCREDIBLE TECHNOLOGIES, INC., Vernon Hills, IL (US)

( * ) Notice: Subject to any disclaimer, the term of this patent is extended or adjusted under 35 U.S.C. 154(b) by 171 days.

(21) Appl. No.: 14/177,373

(22) Filed: Feb. 11, 2014

(65) Prior Publication Data

US 2014/0228090 A1 Aug. 14, 2014

Related U.S. Application Data

(60) Provisional application No. 61/763,221, filed on Feb. 11, 2013.

(51) Int. Cl.
*A63F 9/00* (2006.01)
*G07F 17/32* (2006.01)

(52) U.S. Cl.
CPC ..... *G07F 17/3204* (2013.01); *G07F 17/323* (2013.01); *G07F 17/3227* (2013.01)

(58) Field of Classification Search
None
See application file for complete search history.

(56) References Cited

U.S. PATENT DOCUMENTS

2006/0025206 A1* 2/2006 Walker ..... G07F 17/3227 463/20
2006/0252498 A1* 11/2006 Walker ..... G07F 17/32 463/20
2007/0111771 A1* 5/2007 Ihori ..... A63F 13/10 463/8
2007/0129143 A1* 6/2007 Walker ..... G07F 17/32 463/25
2008/0039197 A1* 2/2008 Walker ..... G07F 17/32 463/30

* cited by examiner

*Primary Examiner* — Seng H Lim
(74) *Attorney, Agent, or Firm* — Husch Blackwell LLP; George S. Pavlik

(57) ABSTRACT

A machine and method of adjusting audio effects of a game played on an electronic gaming machine. The machine and method featuring an electronic audio file format having a plurality of audio files, a plurality of text markers and a plurality of script files, with each audio file having an audio property that can provide a different acoustic effect. During processing and play of the audio file, a text marker associated with a predetermined script file can be identified. The text marker can stop the audio filed being played and play a second audio file with a different audio property different from the prior audio file.

21 Claims, 4 Drawing Sheets

14

| Sound script is called... | if this script is playing, | | then play this audio file. | |
|---|---|---|---|---|
| line_win | → | zz_silence01 | → | line_win_1 |
| | → | zz_silence02 | → | line_win_2 |
| | → | zz_silence03 | → | line_win_3 |
| | → | zz_silence04 | → | line_win_4 |
| | → | zz_silence05 | → | line_win_5 |

Fig. 3

16

| | Command | ScriptName |
|---|---|---|
| 1 | iflsScriptPlaying | INTERFACE.ZZ_SILENCE_LOOP01 |
| 2 | script new fam | BASEGAME.ZZ_LINE_WIN_1 |
| 3 | Else | |
| 4 | iflsScriptPlaying | INTERFACE.ZZ_SILENCE_LOOP02 |
| 5 | script new fam | BASEGAME.ZZ_LINE_WIN_2 |
| 6 | Else | |
| 7 | iflsScriptPlaying | INTERFACE.ZZ_SILENCE_LOOP02B |
| 8 | script new fam | BASEGAME.ZZ_LINE_WIN_2 |
| 9 | Else | |
| 10 | iflsScriptPlaying | INTERFACE.ZZ_SILENCE_LOOP03 |
| 11 | script new fam | BASEGAME.ZZ_LINE_WIN_3 |
| 12 | Else | |
| 13 | iflsScriptPlaying | INTERFACE.ZZ_SILENCE_LOOP04 |
| 14 | script new fam | BASEGAME.ZZ_LINE_WIN_4 |
| 15 | Else | |
| 16 | iflsScriptPlaying | INTERFACE.ZZ_SILENCE_LOOP05 |
| 17 | script new fam | BASEGAME.ZZ_LINE_WIN_5 |
| 18 | Else | |
| 19 | script new fam | BASEGAME.ZZ_LINE_WIN_1 |
| 20 | EndIf | |
| 21 | EndIf | |

Fig. 4

AUTOMATED ADJUSTMENT OF AUDIO EFFECTS IN ELECTRONIC GAME

CROSS-REFERENCE TO RELATED APPLICATION

This application claims the benefit of the filing date of U.S. Provisional Application Ser. No. 61/763,221 filed Feb. 11, 2013 entitled "Automated Adjustment of Audio Effects in Electronic Game," the entirety of which is hereby incorporated herein by reference.

FIELD

The application pertains generally to the adjustment of audio effects in connection with a game played on an electronic gaming machine. More particularly, the application pertains to a game and method for automatically adjusting audio effects in connection with predetermined game conditions, occurrences, or player input.

BACKGROUND

Electronic gaming machines (EGMs) commonly incorporate music or other types of audio signals in connection with game play in order to make the game more dramatic or to provide the player with a more engaging gaming experience that can enhance and maintain interest in the game over time. Although the musical effects and bell tones of such games were traditionally played in the musical key of C (or in the C pentatonic scale), newer versions of games play audio effects in a vast assortment musical keys—Western and otherwise. This evolution can sometimes present problems for sound designers who must either (1) work with existing template sounds that are in a musical key different from that of a new piece of music, or (2) try to come up with a new set of sounds that "split the difference" and minimize the clash of keys.

Accordingly, there is a need in the art for a method of adjusting the audio effects of an electronic game in a manner such that they can be played in varying musical keys or with other modified audio properties. It would additionally be desirable for such method to automatically adjust audio effects of an electronic game in response to predetermined game conditions or game play in order to provide a more dynamic and engaging gaming experience. There is further a need for a game and electronic gaming machine incorporating said method in connection with games played thereon.

BRIEF DESCRIPTION OF THE DRAWINGS

FIG. 3 is a diagram illustrating a sample process of adjusting the audio effects of a game according to embodiments disclosed herein.

FIG. 4 is an array illustrating a portion of a sample command string of instructions stored on a non-transitory computer readable medium for adjusting the audio effects of a game in accordance herewith.

DETAILED DESCRIPTION

Figure 1:
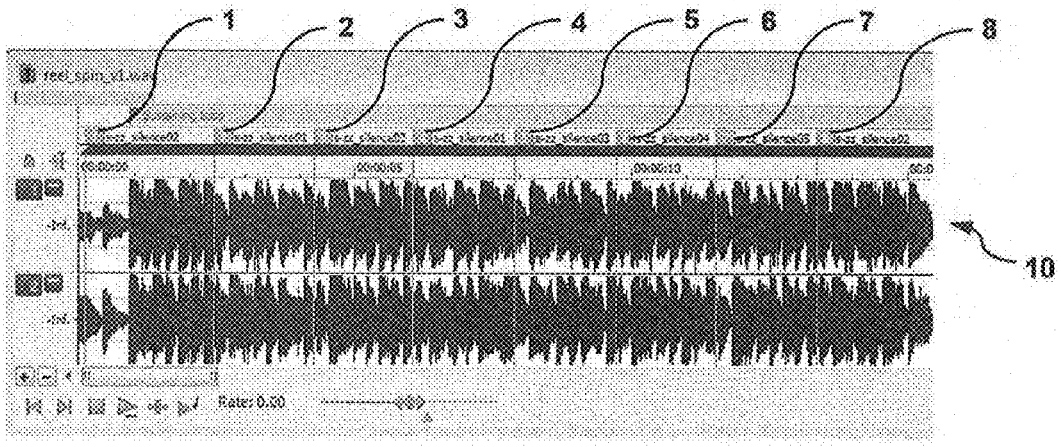
FIG. 1 is a visual representation of an audio file according to embodiments disclosed herein.

While the subject invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated.

Embodiments disclosed herein provide for a game and method that can automatically adjust the audio effects played by an electronic game when a button is pressed or an event occurs in order to match the audio effects which are played in the background while the game is in progress. According to such embodiments, the audio effects can change not only in accord with what is happening on the display, but relative to the particular part of the game which is being played (e.g. during bonus games/free spins the music may become more dramatic, faster, or louder), or the specific mode of the game (e.g. when the player is playing max lines/max bet the music may be more dramatic or faster than when the player is playing less than max bet and/or less than max lines).

Although it has traditionally been believed that audio cues for such games should be consistent so that the player will always be able to recognize and understand the particular outcome or events of the game, it has been recognized that adjusting the pitch of the audio effects as set forth herein can allow for a more integrated experience with no loss of cue association from the player.

According to embodiments presented herein, the subject methods and games can include text markers embedded in an audio file format, such as for example a .wav file. Once recognized, such markers can call other scripts which can change the audio effect by stopping the play the current audio file and starting a new audio file with a different acoustic effect. In one example, such embodiments can be used in connection with the reel spin music played in connection with a traditional slot-type gaming machine. According to such embodiments, the music can weave through five musical keys—with a number assigned to each key, for example:

A minor=1
E major=2
F major=3
C major=4
D minor=5

FIG. 1 illustrates a visual representation of an audio file 10 for audio effects according to such an embodiment. In this embodiment, text markers 1-8 can be used as a command to start another script. For instance, marker 2 named "s-zz_silence01" can start a corresponding script file named "zz_silence01," and so on. While this numbering is consistent with the above list of musical keys and the assigned numbers, it will be recognized that alternative naming convention could be utilized without departing from the novel scope of the subject invention.

Figure 2:
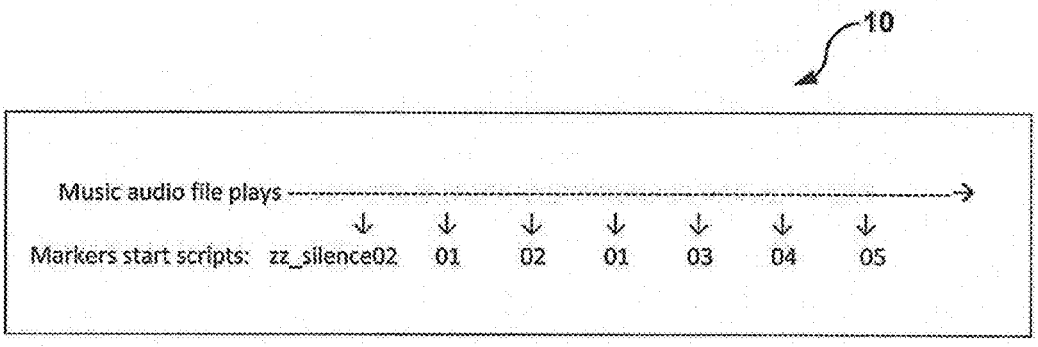
FIG. 2 is a graphical representation of an audio file incorporating marker start scripts according to embodiments disclosed herein.

FIG. 2 illustrates a graphical representation of a portion of the audio file 10 shown in FIG. 1 incorporating marker start scripts. In this embodiment, each "silence" script can play a continuous loop of silence (a short audio file with no sound) and, thus, acts as a numbered "flag." As each numbered "flag" plays (until it is stopped by the next "flag"), it can be referenced by IF statements placed in other scripts. For example, when audio file 10 is associated with a line-win and the line-win sound script is called, the instructions can call for a list of "flags" to be reviewed in order to determine which line-win audio file should actually play. FIG. 3 is a chart diagram illustrating a process 12 according to the embodiment and It will be recognized that embodiments of the subject invention are not limited to adjusting audible effects only in connection with win-lines and can be directed to any other type of musical or audio effects used in connection with a particular type of gaming machine, such as for example a payout bell, spin and max bet buttons and reel stop tones. In addition, it will be further understood that although FIGS. 1-4 illustrate an embodiment having five musical keys, any number of keys can be used. The subject invention can additionally include separate versions of each musical or audio effect in order to achieve different keys. Moreover, persons of ordinary skill in the art will further understand that, in addition to varying musical keys of an audio effect, embodiments disclosed herein can be used to adjust other audio properties, such as for example, pitch, tone, frequency, duration, loudness, intesity and/or timbre.

FIG. 4 illustrates an example command string 14 where each IF statement can be followed by what audio file should be played. In the example command string 14 illustrated in FIG. 4, the last audio script "basegame.zzline_win_1" is not paired with an "iflsScriptPlaying" statement. In this embodiment, this script can be designated as the default setting, which can function as a safety backup. In other words, if a new game session started and no music is played, a line win can result in the default audio file being selected and played. Such default audio file can be associated with a predetermined audio effect, such as for example, a sound played in the key of A minor.

Figure 5:
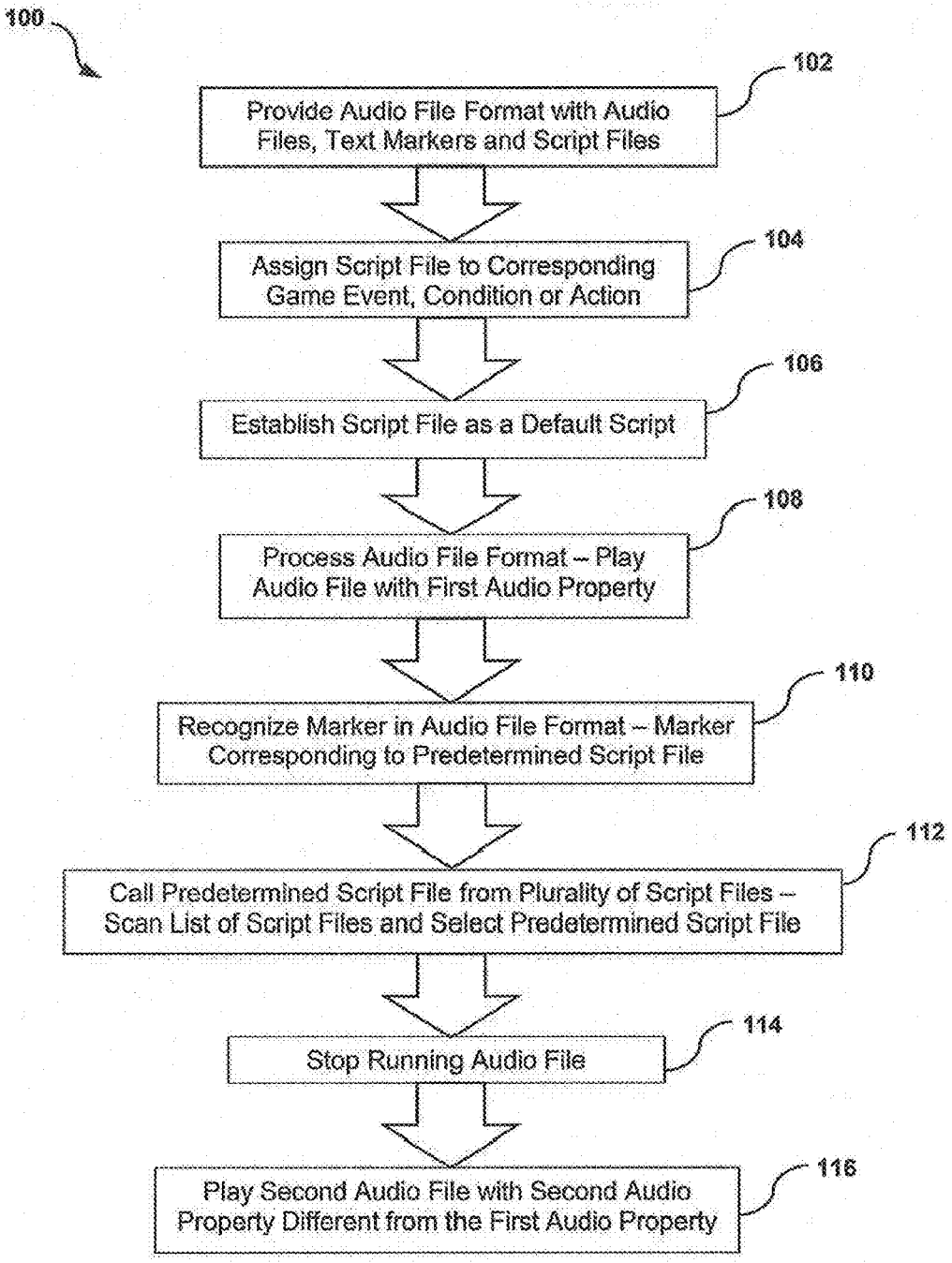
FIG. 5 is a flow chart illustrating a method of adjusting audio effects of a game according to embodiments presented herein.

FIG. 5 is a flowchart illustrating a method 100 of adjusting audio effects of a game according to embodiments disclosed herein. According to such method 100, an electronic audio file format can be provided 102 having a plurality of audio files, a plurality of embedded text markers and a plurality of script files. The audio file format can be of any type or format suitable for electronically storing digital audio data in compressed or uncompressed form, including for example, .wav, .mmf, .mp3, .msv, .m4a, .m4p or any other file format without limitation.

Each of the script files can be associated or assigned 104 a corresponding event, condition or action from the game and each audio file can have an audio property that can provide a different auditory or acoustic effect. In addition, as described previously, at least one script file can be established 106 as a default script file which can play an audio file with a default audio property absent a text marker or preceding game condition.

As illustrated in FIG. 5, the audio file format can be processed 108 and at least one audio file can be played. Such processing can be performed by a programmable processor and control circuitry. In processing 108 the audio file format, a text marker associated with a predetermined script file can be recognized 110 and the corresponding script file can be called 112 by scanning a list of script files and selecting the respective file corresponding to the corresponding text marker. The selected script file can stop 114 the audio file being run or played and start playing 116 a new audio file which can have different audio properties from the previously played audio file. In carrying out this method 100, an audio effect of the game can be adjusted so that it has different acoustic or auditory properties.

Figure 6:
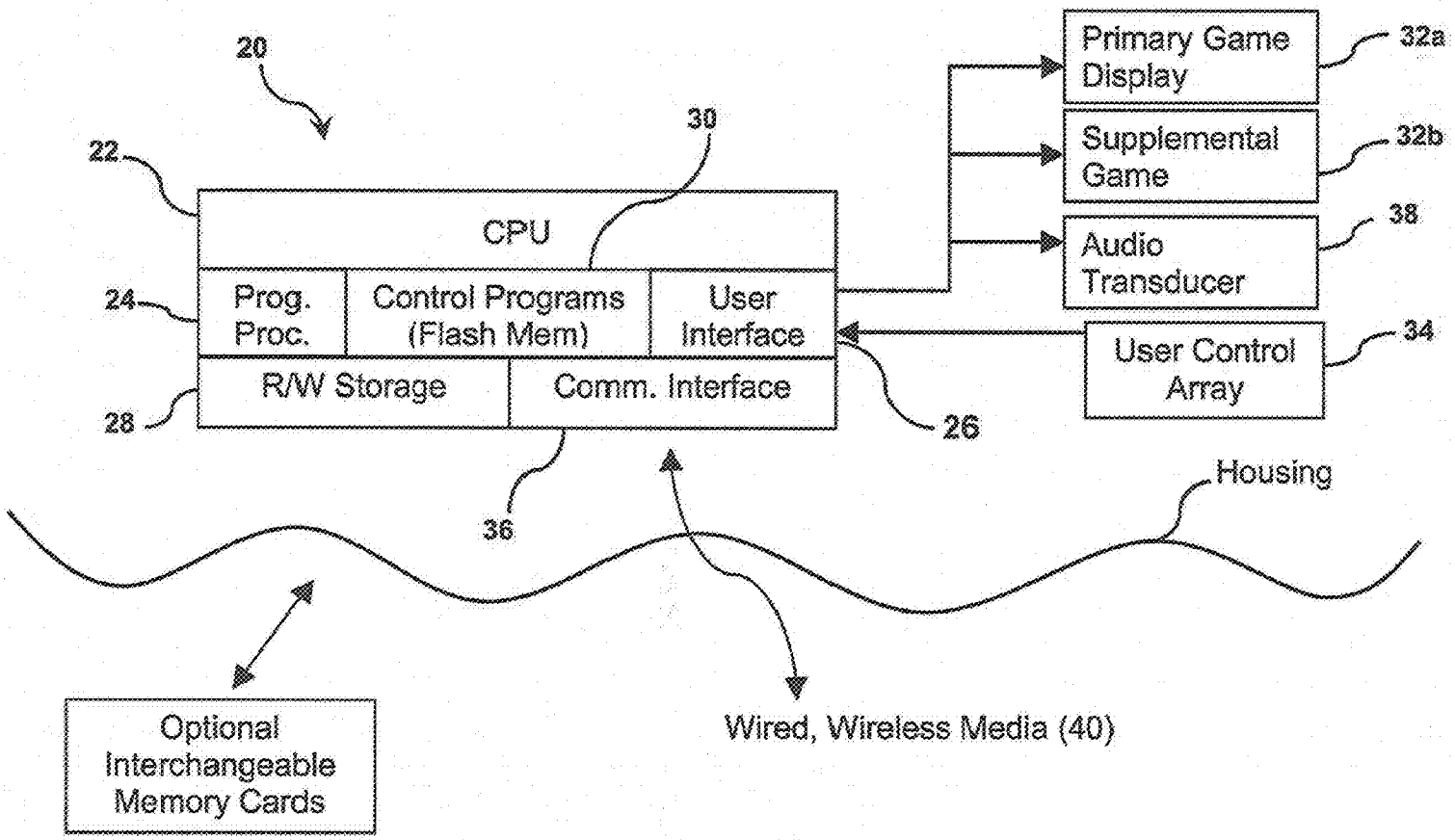
FIG. 6 is a diagram illustrating a representational view of a gaming machine according to embodiments disclosed herein.

FIG. 6 illustrates a representational view of the components of the gaming machine 20 that can adjust the audio effects of a game by performing the method disclosed herein. The gaming machine 20 can have a computer 22 having control circuitry electrically coupled to one or more game displays 32*a*, 32*b*. Displays 32*a*, 32*b* can visually present images or representations of rotating slot-type reels as would be expected by players of such games, and/or other electronic representations of other types of game arrays. The game displays 32*a*, 32*b* can be any kind of conventional electronically controlled video monitor, including for example, a CRT, high resolution flat-panel LCD, plasma/LED display. It will recognized that any or all of the displays 32*a*, 32*b* can further have touch-screen capabilities in order to enable players to input or control certain aspects or features of the game.

The computer 12 can include a programmable processor 24, control programs 26 and associated circuitry, a user interface 26 and at least one storage unit 28 electronically coupled to the processor 24. The storage unit 28 can store a plurality of instructions executable by the programmable processor 24. The computer 22 can also include a memory unit 30 which can contain dynamic information processed by the programmable processor 24 during operation, and/or a static memory which contains fixed information, such as an operating system, game programs, and configuration information necessary for the processor 24 to process input from a player through a control array 34.

The control array 34 can be implemented as one or more of a keyboard, mechanical lever, a touch-screen, buttons or pads and/or any other means for control, or desired combination of controls, able to accept input from a player and produce output to the game display 32*a*, 22*b* in response to a player's input. As shown in FIG. 1, the control array 34 can be electrically coupled to the computer 22 via the user interface 26.

The gaming machine 20 can further have communication means for transmitting audio and related game information to a remote computer, network or display device. Such communication means can include a communication interface 36 for communicating with other computers, networks or electronic devices via wired or wireless communications network 40. The gaming machine can additionally have one or more transducers or speakers 38 for transmission the audio effects played during the game From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

What is claimed is:

1. A method of adjusting an audio property of an audible sound in a game played on an electronic gaming machine comprising:

providing an electronic audio file format having a plurality of audio files, a plurality of text markers embedded in the audio files and a plurality of script files, each script file being associated with an event or condition of the game and each audio file having an acoustic effect having one of a plurality of different audio properties for the same audible sound;

processing the audio file format in connection with the game, the processing playing a first audio file of the plurality of audio files, the first audio file outputting the audible sound with a first audio property of the plurality of audio properties;

recognizing a text marker embedded in the audio file format, the text marker associated with a predetermined script file of the plurality of script files;

calling the predetermined script file from the plurality of script files;

stopping the first audio file;

playing a second audio file having a second audio property from the plurality of audio properties for the same audible sound, the second audio property being different from the first audio property, the playing of the second audio file outputting the audible sound with the second audio property.

2. The method of claim 1 where the acoustic effect comprises a key of a piece of music and the different audio properties comprise different musical keys.

3. The method of claim 1 where calling a script file includes scanning a list of script files and selecting the second audio file for play.

4. The method of claim 1 where the plurality of audio files are associated with winning outcomes for the game.

5. The method of claim 1 where the audible sound is music played while visually presented representations of reels of a slot-type gaming machine are being rotated.

6. The method of claim 1 further comprising establishing at least one script file as a default script file, the default script file playing an audio file with a default audio property without recognizing a text marker.

7. The method of claim 3 where selecting the second audio file is based on a game event or condition that has taken place in the game, the event or condition being associated with the second audio file.

8. An electronic gaming machine comprising:

at least one electronic display for visually presenting a game played on the gaming machine;

a transducer for producing audio effects in connection with the game;

a control array;

a programmable processor and control circuitry electrically coupled to the display, transducer and control array;

an electronic audio file format having a plurality of audio files, a plurality of text markers embedded in the audio files and a plurality of script files, each audio file having an acoustic effect having one of a plurality of different audio properties for the same audible sound;

instructions stored on a computer readable medium, the instructions being executable by the processor and control circuitry to process the audio file format during play of a game on the gaming machine, the audio file format playing a first audio file of the plurality of audio files, the first audio file outputting the audible sound with a first audio property of the plurality of audio properties; recognizing a text marker embeded in the audio file format, the text marker associated with a predetermined script file of the plurality of script files; calling the predetermined script file from the plurality of script files; stopping the first audio file; playing a second audio file having a second audio property from the plurality of audio properties for the same audible sound, the second audio property being different from the first audio property, the playing of the second audio file outputting the audible sounds with the second audio property.

9. The machine of claim 8 further comprising a communication interface coupled to the processor, the interface configured to communicate with other electronic devices via wired or wireless transmission of electrical signals.

10. The machine of claim 8 where the at least one electronic display comprises a CRT, LCD, plasma or LED display.

11. The machine of claim 8 where the control array comprises a keyboard, mechanical lever, button or touch-screen.

12. The machine of claim 8 further comprising a device for accepting wagers on the outcome of the game.

13. The machine of claim 8 where the programmable processor and control circuitry are situated in a location remote to the control array, transducer and at least one display.

14. The machine of claim 8 where the gaming machine is a slot-type gaming machine and the plurality of audio files are associated with music played while visually presented representations of reels of a slot-type gaming machine are being rotated.

15. The machine of claim 8 where the plurality of audio files are associated with winning outcomes for the game.

16. The machine of claim 8 where the audio file is .wav format with text markers embedded therein.

17. An electronic gaming machine comprising:

first circuitry that stores a plurality of audio files, a plurality of text markers embedded in the audio files and a plurality of script files, each script file being associated with an event or condition of a game and each audio file having an audio property providing a different acoustic effect for the same audible sound;

second circuitry that processes the audio files in connection with playing the game, the processing playing a first audio file of the plurality of audio files via an audio transducer, the processing of the first audio file outputting the audible sound with a first audio property;

the second circuitry recognizing a text marker embedded in the audio file format, the text marker associated with a predetermined script file of the plurality of script files, calling the predetermined script file from the plurality of script files, stopping the first audio file, and playing a second audio file having a second audio property different from the first audio property via the audio transducer, the playing of the second audio property outputting the audible sound with the second audio property.

18. The gaming machine of claim 17 where the accoustic effect comprises a key for a piece of music and the first and second audio properties comprises different musical keys.

19. The gaming machine of claim 17 where members of the plurality of audio files are associated with winning outcomes for the game.

20. The gaming machine of claim 17 where the plurality of audio files are associated with music played while visually presented representations of reels of a slot-type gaming machine are being rotated.

21. The gaming machine of claim 17 further comprising at least one script file as a default script file, the default script file playing an audio file with a default audio property without recognizing a text marker.

* * * * *